US005267320A

United States Patent [19]

Fukumizu

[11] Patent Number: 5,267,320

[45] Date of Patent: Nov. 30, 1993

[54] NOISE CONTROLLER WHICH NOISE-CONTROLS MOVABLE POINT

[75] Inventor: Kenji Fukumizu, Yokohama, Japan

[73] Assignee: Ricoh Company, Ltd., Tokyo, Japan

[21] Appl. No.: 851,375

[22] Filed: Mar. 12, 1992

[30] Foreign Application Priority Data

| | | | |
|---|---|---|---|
| Mar. 12, 1991 | [JP] | Japan | 3-072447 |
| Mar. 29, 1991 | [JP] | Japan | 3-093678 |
| Mar. 29, 1991 | [JP] | Japan | 3-093691 |
| Nov. 15, 1991 | [JP] | Japan | 3-328022 |

[51] Int. Cl.[5] ..... G10K 11/16

[52] U.S. Cl. ..... 381/71; 381/94

[58] Field of Search ..... 381/71, 94

[56] References Cited

U.S. PATENT DOCUMENTS

| | | | |
|---|---|---|---|
| 5,022,082 | 6/1991 | Eriksson et al. | 381/71 |
| 5,117,642 | 6/1992 | Nakanishi et al. | 381/71 |
| 5,133,017 | 7/1992 | Cain et al. | 381/71 |

FOREIGN PATENT DOCUMENTS 61-127377 6/1986 Japan .
61-262166 11/1986 Japan .

OTHER PUBLICATIONS

Hareo Hamada et al., "Active Noise Control Chair," *The Institute of Electronics, Information and Communication Engineers EA90-2*, Apr. 26, 1990, pp. 7-14.

*Primary Examiner*—Forester W. Isen
*Attorney, Agent, or Firm*—Mason, Fenwick & Lawrence

[57] ABSTRACT

A noise controller which noise-controls a movable point so that a noise generated from a noise source and transmitted to the movable point can be reduced. The noise controller filters the noise in accordance with a least mean square algorithm and generates an antinoise to be collided with the noise so that the antinoise and the noise can cancel each other out. When a filter coefficient used for the least mean square algorithm is renewed, the noise controller uses position data of the movable point. Thus, even if the movable point moves, the proper noise-control can be performed.

15 Claims, 15 Drawing Sheets

FIG. 4

| DISTANCE | TRANSFER FUNCTION |
|---|---|
| L1 | C(1) |
| L2 | C(2) |
| \| | \| |
| Lm | C(m) |

NOISE CONTROLLER WHICH NOISE-CONTROLS MOVABLE POINT

BACKGROUND OF THE INVENTION

The present invention relates generally to noise controllers, and more particularly to a noise controller for controlling a noise at a predetermined point by colliding an antinoise with the noise to cancel each other out.

"ACTIVE NOISE CONTROL CHAIR", THE INSTITUTE OF ELECTRONICS, INFORMATION AND COMMUNICATION ENGINEERS EA90-2, Apr. 26, 1990, by HAMADA et al. discloses a noise controller shown in FIG.1 for noise-controlling a predetermined position by colliding an antinoise with a noise to cancel each other out. The noise controller shown in FIG.1 comprises a noise detector 51, a signal processor 52, an antinoise generator 53, a residual-noise detector 54, and a coefficient renewing device 55. The noise detector 51 includes a microphone for converting a noise generated from a noise source 50 into an electric signal x(n); n representing time. The signal processor 52 includes a digital filter for filtering the electric signal x(n) to generate a signal s(n). The antinoise generator 53 includes an antinoise speaker for generating an antinoise to be collided with the noise, the antinoise being determined so that when the antinoise is collided with the signal s(n) they can cancel each other out. However, actually, the antinoise and the noise cannot completely cancel each other out, and thus they generate a residual noise. The residual-noise detector 54, located at a noise-controllable point which is expected to be noise-controlled, includes a microphone for converting the residual noise into an electric signal e(n). The coefficient renewing device 55 receives the signal e(n), and renews a filter coefficient of the digital filter in the signal processor 52, so that the signal e(n) at the residual-noise detector 54 is removed.

The coefficient renewing device 55 usually renews a filter coefficient by a least mean square (abbreviated LMS hereinafter) algorithm. Hereupon, e(n) and s(n) are respectively defined as follows:

$$e(n) = y(n) + \sum_j C_j * s(n-j) \tag{1}$$

$$s(n) = \Sigma\, W_i(n) * x(n-i), \tag{2}$$

where $C_j$ represents a transfer function between the antinoise generator 53 and the residual-noise detector 54 (noise-controllable point), a convolution of $C_j$ and s(n-j) represents the antinoise input to the residual-noise detector 54, and $w_i(n)$ represents a filter coefficient used for the signal processor 52. According to the LMS algorithm, the coefficient renewing device 55 renews a filter coefficient whenever $w_i(n)$ is renewed every sample so that a square error $\sigma(n)$ of the signal e(n), namely, $[e(n)^2$, can be minimized as time n goes. In the LMS algorithm, since squared e(n) defined by the equation (1) is defined by a secondary equation of $w_i$, the square error Z, defined as follows, may be regarded as the secondary equation of $w_i$ and thus the filter coefficient $w_i$ is renewed every sample in accordance with a descent method.

$$Z = \sigma(n) \tag{3}$$

In this case, the filter coefficient $w_i$ at time (n+1) is defined by using the filter coefficient $w_i$ at time n, as follows:

$$w_i(n+1) = w_i(n) + \delta w_i(n) \tag{4}$$

$$\delta w_i = -\alpha * e(n) * \sum_j C_j * x(n-i-j), \tag{5}$$

where $\alpha$ represents a convergent coefficient.

However, the above noise controller in conformity to the LMS algorithm has the following disadvantages:

1. The noise controller cannot handle a movable noise-controllable point where the residual-noise detector 54 is located, since $C_j$ can be calculated for the fixed noise-controllable point, in accordance with a system identification method. Thus, to calculate the transfer function $C_j$, it is necessary to fix both the antinoise generator 53 and the noise-controllable point. However, if the noise-controllable point is considered as a movable human ear, $w_i$ cannot be properly renewed, and thus the residual noise cannot be properly eliminated.

2. It takes much time to identify $C_j$ in accordance with the system identification method whenever the noise controller is driven, so that it takes much time to noise-control a desired point.

SUMMARY OF THE INVENTION

Accordingly, it is a general object of the present invention to provide a novel and useful noise controller in which above disadvantages are eliminated.

Another more specific object of the present invention is to provide noise controller which quickly noise-controls a movable point.

With the foregoing in mind, the noise controller according to the present invention which which noise-controls a movable point so that a noise generated from a noise source and transmitted to the movable point can be reduced comprises noise detecting means, located near the noise source, for detecting the noise, and for generating a first signal representing the noise, signal processing means including a digital filter which has a filter coefficient, coupled to the noise detecting means, for generating a second signal by signal-processing the first signal via the digital filter, antinoise generating means, coupled to the signal processing means, for generating an antinoise from the second signal so that, if the antinoise is collided with the second signal, the antinoise and the second signal can cancel each other out, for outputting the antinoise to the movable point so as to collide the antinoise with the noise, the antinoise being , residual-noise detecting means, located at the movable point, for detecting a residual noise generated from the noise collided with the antinoise, and for generating a third signal representing the residual noise, position detecting means for detecting a position of the movable point, and coefficient renewing means, coupled to the residual-noise detecting means, for renewing the filter coefficient of the digital filter in the signal processing means based on the position of the movable point detected by the position detecting means so that the movable point can be properly noise-controlled even when the movable point moves, said coefficient renewing means renewing the filter coefficient in accordance with a least mean square algorithm in which the filter coefficient is renewed so that a squared third signal can be minimized.

Another noise controller according to the present invention which noise-controls a predetermined point so that a noise generated from a noise source and transmitted to the predetermined point can be reduced comprises noise detecting means, located near the noise source, for detecting the noise, and for generating a first signal representing the noise, first signal processing means including a first digital filter which has a filter coefficient, coupled to the noise detecting means, for generating a second signal by signal-processing the first signal via the first digital filter, antinoise generating means, coupled to the first signal processing means, for generating an antinoise from the second signal so that, if the antinoise is collided with the second signal, the antinoise and the second signal can cancel each other out, and for outputting the antinoise to the predetermined point so as to collide the antinoise with the noise, residual-noise detecting means, located at the movable point, for detecting a residual noise generated from the noise collided with the antinoise, and for generating a third signal representing the residual noise, process memory means, coupled to the first signal processing means, for storing therein a just previously renewed filter coefficient, and first coefficient renewing means, coupled to the residual-noise detecting means and the process memory means, for renewing, while converging, the filter coefficient of the first digital filter in accordance with a least mean square algorithm, by using the just previously renewed filter coefficient stored in the process memory so as to quickly converge the filter coefficient, in which least means square algorithm the filter coefficient of the first digital filter is renewed so that a squared third signal can be minimized.

According to a first aspect of the present invention, since the filter coefficient is renewed by taking into consideration the position of the movable point, the movable point can be properly noise-controlled even when it moves. According to a second aspect of the present invention, since the just previously renewed filter coefficient is used for the subsequent operation, the filter coefficient can be quickly converged in the subsequent operation.

Other objects and further features of the present invention will become apparent from the following detailed description when read in conjunction with the accompanying drawings.

BRIEF DESCRIPTION OF THE DRAWINGS

FIG.4 shows a table for correlating transfer functions with distances, which table is stored in a transfer-function register of the noise controller shown in FIG.3;

DETAILED DESCRIPTION OF THE PREFERRED EMBODIMENTS

Figure 2:
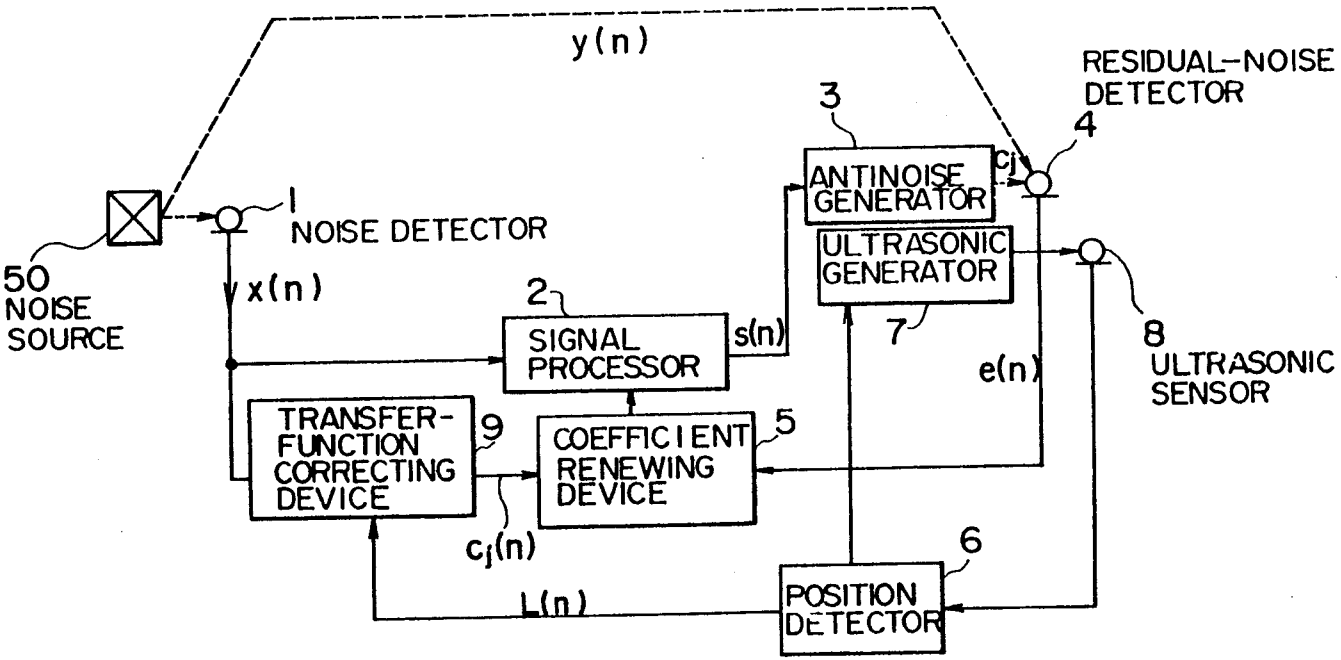
FIG.2 shows systematic block diagram of a noise controller of a first embodiment according to the present invention.

A description will now be given of a noise controller of a first embodiment according to the present invention with reference to FIG.2. The noise controller comprises, as shown in FIG.2, a noise detector 1, a signal processor 2, an antinoise generator 3, a residual-noise detector 4, a coefficient renewing device 5, a position detector 6, an ultrasonic generator 7, an ultrasonic sensor 8, and a transfer-function correcting device 9. According to this embodiment, the transfer function $C_j$ between the antinoise generator 3 and the noise-controllable point (residual-noise detector 4) is time-sequentially corrected by measuring the distance therebetween via the position detector 6, the ultrasonic generator 7, and the ultrasonic sensor 8, and a filter coefficient $w_i$ of the digital filter in the signal processor 2 is renewed by the coefficient renewing device 5, based on the corrected transfer function $C_j$.

The noise detector 1, located near the noise source 50, includes a microphone for converting noise generated from the noise source 50 into an electric signal x(n); n representing time. The noise detector 1 may include a sensor which detects a mechanical acoustic wave and converts it into an electric signal. If the noise source 50 comprises a rotating motor, the noise detector 1 may be comprised of a detector for detecting a rotating frequency of the motor, and for converting it into the electric signal. Otherwise, if the noise generated from the noise source 50 comprises a mechanical vibration, the noise detector 1 may be comprised of a vibration pickup for converting a vibration into the electric signal x(n).

The signal processor 2, coupled to the noise detector 1, includes a digital filter for filtering the electric signal x(n), and for generating a signal s(n) representing a filtered signal x(n).

The antinoise generator 3, coupled to the signal processor 2, includes an antinoise speaker which outputs an antinoise to the noise-controllable point so as to collide the antinoise with the noise, the antinoise being generated from the signal s(n) so that, when the antinoise is collided with the signal s(n), they can cancel each other out.

The residual-noise detector 4, located at the noise-controllable point, includes a microphone for converting a residual noise generated as a result of colliding the antinoise with the noise, and for generating an electric signal e(n) representing the residual noise.

The coefficient renewing device 5, coupled to the signal processor 2 and the residual-noise detector 4, renews a filter coefficient used for the signal processor 2 in accordance with the LMS algorithm in which the signal e(n) can be minimized as time goes.

The position detector 6 detects a position of the residual-noise detector 4 by measuring a distance between the noise-controllable point and the antinoise generator 3. The position detector 6 is coupled to the ultrasonic generator 7 and the ultrasonic sensor 8. The ultrasonic generator 7 is attached to the antinoise generator 3, whereas the ultrasonic sensor 8 is attached to the residual-noise generator 4. The position detector 6 obtains time-sequential position data of the residual-noise detector 4, the position data being generated by measuring a time interval, every discrete time, in which time interval an ultrasonic wave generated from the ultrasonic generator 7 reaches the ultrasonic sensor 8. Incidentally, it is desirable that four ultrasonic generators 7 are used for each residual-noise detector 4 since one points in the space is defined by four known points. However, three ultrasonic generators 7 are practical since they can restrict the number of points in the space up to two. Each of the four ultrasonic generators 7 generates an ultrasonic wave having a different frequency, and the ultrasonic sensor 8 receives these different frequencies of ultrasonic waves. Thus, if each time interval in which each ultrasonic wave reaches the residual-noise detector 4 is detected, the position of the residual-noise detector 4 ca be specified.

The transfer-function correcting device 9 calculates the transfer function $C_j$ between the antinoise generator 3 and the noise-controllable point (the residual-noise detector 4), based on the distance therebetween detected by the position detector 6, and then informs the coefficient renewing device 5 of it. The coefficient renewing device 5 renews a filter coefficient of the digital filter in the signal processor 2 based on the transfer function $C_j$ corrected by the transfer-function correcting device 9, so that the square error $\sigma(n)$ is minimized as time goes.

Next follows a description of an operation of how the filter coefficient wi is renewed. When the noise controller is driven, the residual-noise detector 4 is positioned at an initial position. Then an initial distance $L^0$ between the antinoise generator and the residual-noise detector 4 is determined, so as to calculate a corresponding transfer function $C^0$. After the noise controller is driven, a distance L(n), at time n, between the antinoise generator 3 and the residual-noise detector 4 is detected. Thus, the transfer-function correcting device calculates the transfer function $C_j(n)$ as follows:

$$C_j(n)=(L^0/L(n))*C_{j-d}^0 \quad (6)$$

$$d=(L(n)-L^0)*(s_f/v_s) \quad (7)$$

, where $s_f$ represents a sampling frequency, and $v_s$ represents the sound speed. In the above equations (6) and (7), it is assumed that an acoustic wave which propagates between the antinoise generator 3 and the residual-noise generator 4 consists of a direct sound wave. If the distance between the antinoise generator 3 and the residual-noise detector 4 is small, and a reflected sound wave hardly affects the residual noise, a satisfactorily-approximated transfer function $C_j(n)$ can be obtained from the above equations (6) and (7). Incidentally, the term $(L^0/L(n))$ in the equation (6) is calculated by using the physical fact that the strength of a spheric acoustic wave is in inverse proportional to the distance from a sound source.

After the transfer function $C_j(n)$ is calculated by the transfer-function correcting device 9, it is transmitted to the coefficient renewing device 5. Subsequently, the coefficient renewing device 5 renews the filter coefficient $w_i$ by using $C_j(n)$ in accordance with the LMS algorithm.

Figure 3:
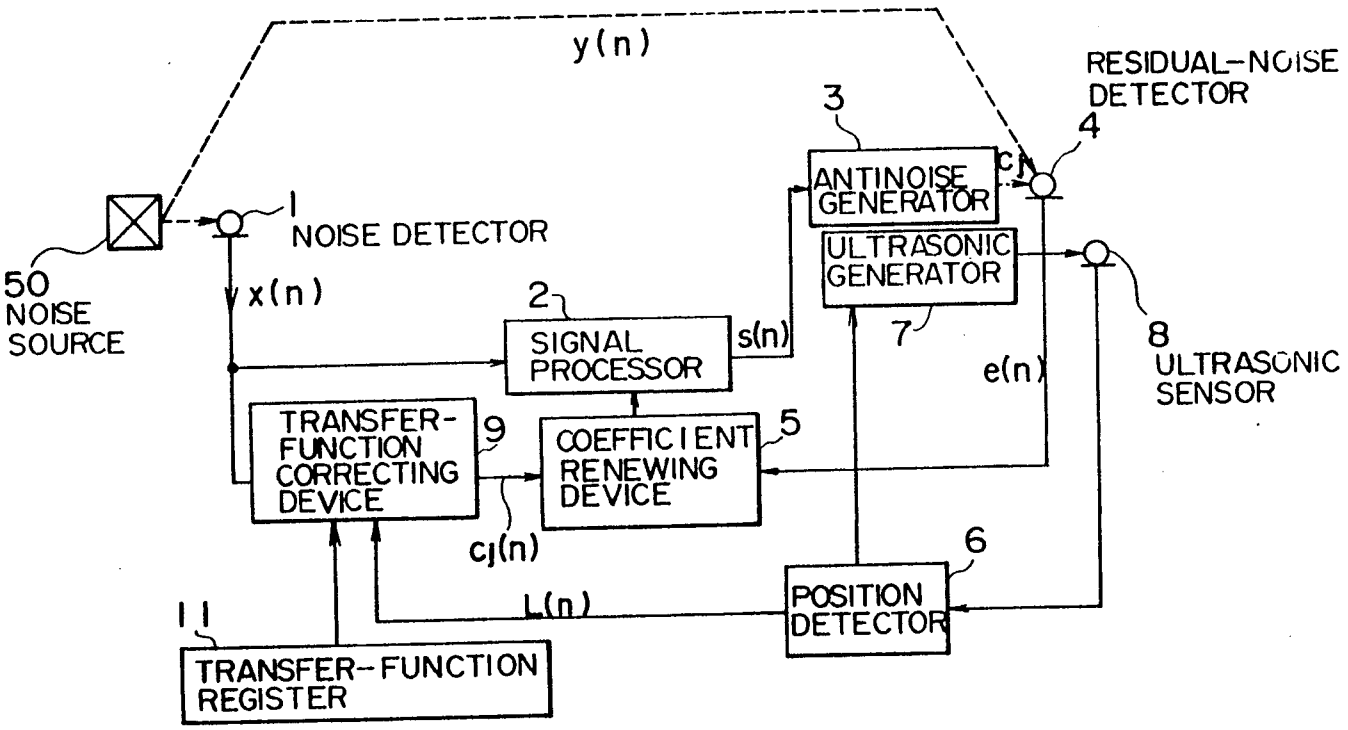
FIG.3 shows a systematic block diagram of a noise controller of a second embodiment according to the present invention.

Next follows a description of a noise controller of a second embodiment according to the present invention with reference to FIG.3. Those elements in FIG.3 which are the same as corresponding elements in FIG.2 are designated by the same reference numerals, and a description thereof will be omitted. In the noise controller of this embodiment, a transfer-function resister 11 and a transfer-function renewing device 12 supercede the transfer-function correcting device 9.

The transfer-function register 11 stores a table, as shown in FIG.4, which correlates various transfer functions with different positions of the noise-controllable point. The table shown in FIG.4 is produced by dividing a noise-controllable space by a predetermined lattice interval. A plurality of residual-noise detectors 4 are installed for each lattice-point. If distances from the antinoise generator 3 and respective residual-noise detectors 4 are labeled as L1, L2, . . . , Lm, corresponding transfer functions C(1), C(2), . . . , C(m) ar ®calculated.

The transfer-function renewing device 12 reads out one of the transfer functions from the transfer-function register 11, based on the distance between the antinoise generator 3 and the residual-noise detector 4.

Next follows a description of a characteristic operation of the noise controller shown in FIG.3. After the noise controller is driven, the position data of the residual-noise detector 4 is input, as a distance L(n) between the residual-noise detector 4 and the antinoise generator 3, from the position detector 6 to the transfer-function renewing device 12. The transfer-function renewing device 12 selects one of the transfer functions corresponding to a distance closest to the input distance L(n), from the transfer-function register 11 and gives it to the coefficient renewing device 5. The transfer-function renewing device 12 reads out one of the transfer functions every discrete time n. The coefficient renewing device 5 renews the filter coefficient $w_i(n)$ in accordance with the LMS algorithm by using the transfer function read out by the transfer-function renewing device 12, so that the square error (n) can be diminished.

According to the first and second embodiments, since, even if the noise-controllable point moves while the noise controller is driving, the filter coefficient $w_i$ is renewed by using the transfer function between the antinoise generator 3 and the moved noise-controllable point, a desirable noise control can be performed for the movable noise-controllable point, such as a user's ear. Incidentally, the present invention is applied to a plurality of noise sources 50, antinoise generators 3 and residual-noise detectors 4.

Figure 5:
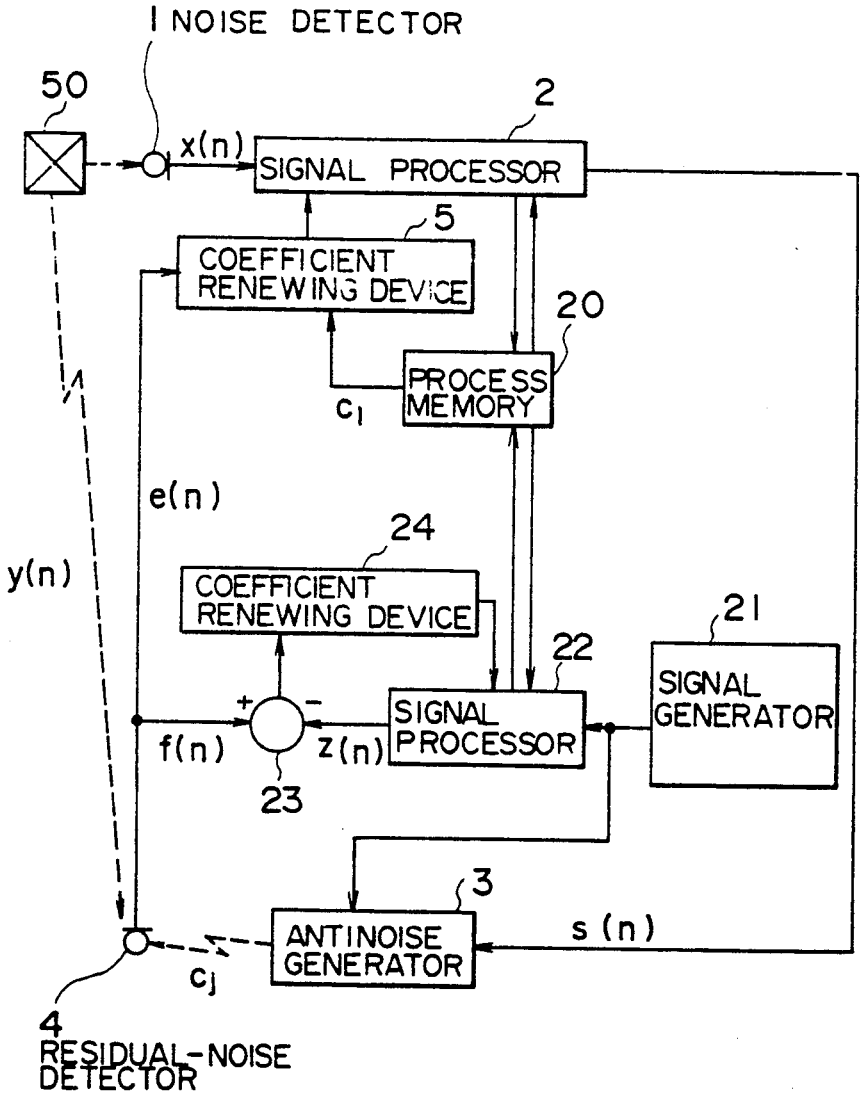
FIG.5 shows a systematic block diagram of a noise controller of a third embodiment according to the present invention.

Next follows, with reference to FIG.5, a description of a noise controller of a third embodiment according to the present invention. Those elements in FIG.5 which are the same as corresponding elements in FIG.2 are designated by the sam reference numerals, and a description thereof will be omitted. The noise controller of this embodiment includes a process memory 20, a signal generator 21, a signal processor 22, a comparator 23, and a coefficient renewing device 24. In addition, the noise controller has a system identification mode and a noise control mode: When the noise controller becomes the system identification mode, it identifies the transfer function $C_j$ between the antinoise generator 3 and the noise-controllable point (residual-noise detector 4) in accordance with the system identification method. On the other hand, when the noise controller becomes the noise control mode, it noise-controls the noise-controllable point. It is the aim of this noise controller to quickly noise-control the noise-controllable point.

The process memory 20 stores the just previous process of the noise controller, as an initial value for the subsequent process. Therefore, when the noise controller is driven, the digital filter in the signal processor 2 uses the filter coefficient defined by the initial value stored in the process memory 20. In addition, the process memory 20 stores a transfer function $C_j$ which was just previously identified while the noise controller was the system identification mode.

The signal generator 21 generates a white noise to calculate the transfer function $C_j$. The white noise is input to the signal processor 22 and the antinoise generator 3. In response, the antinoise generator 3 generates an antinoise defined by the white noise, and the residual-noise detector 4 detects the antinoise defined by the white noise, and generates a signal f(n).

The signal processor 22, coupled to the signal generator 21, includes a digital filter which filters the white noise generated from the signal generator 21, and generates a signal z(n) representing the filtered white noise.

The comparator 23, coupled to the signal processor 22 and the residual-noise detector 4, compares the signal f(n) with the signal z(n).

The coefficient renewing device 24, coupled to the comparator 23 and the signal processor 22, receives the comparison result of the comparator 23, and renews a filter coefficient of the digital filter in the signal processor 22 in accordance with the LMS algorithm so that the signal f(n) and the signal z(n) can be equal to each other in the comparator 23. Incidentally, the coefficient renewing device 24 can calculate a transfer function between the antinoise generator 3 and the residual-noise detector 4.

Next follows a description of an operation of the noise controller. Incidentally, the residual-noise detector 4 is initially located at the noise-controllable position. When the noise controller becomes the system identification mode, the white noise is output from the signal generator 21 to the signal processor 22 to be filtered by the digital filter in the signal processor 22. Then the signal processor 22 outputs the signal z(n) to the comparator 23. Simultaneously, the white noise is input to the antinoise generator 3, and consequently the antinoise generator 3 generates the antinoise defined by the white noise. The residual-noise detector 4 detects the antinoise, and outputs the signal f(n) to the comparator 23. The comparator 23 compares the signal f(n) with the signal z(n), and outputs the comparison result to the coefficient renewing device 22. The coefficient renewing device 22 renews the filter coefficient of the digital filter in the signal processor 22 so that the signal f(n) can be equal to the signal z(n). In addition, the coefficient renewing device 24 calculates the transfer function Cj between the antinoise generator 3 and the noise-controllable point in accordance with the system identification method. When the filter coefficient may be regarded convergent, the system identification mode is cancelled. In addition, the transfer function $C_j$ calculated by the coefficient renewing device is stored in the process memory 20 to be used as an initial value for the subsequent noise control mode.

Next, the noise controller becomes the noise control mode to noise-control the noise-controllable point. The noise generated from the noise source 50 is converted into the electric signal x(n) by the noise detector 1, filtered by the signal processor 2, and input to the antinoise generator 3. The antinoise generator 3 generates the antinoise based on the filtered electric signal s(n) so that, if the antinoise is collided with the signal s(n), the antinoise and the signal can cancel each other out. The residual-noise detector 4 detects the residual noise generated from the noise y(n) collided with with the antinoise, and output the signal e(n) representing the residual noise to the coefficient renewing device 5. The coefficient renewing device 5 renews, in accordance with the LMS algorithm, the filter coefficient $w_i$ of the digital filter in the signal processor 2, by using the filter coefficient and the transfer function which were stored in the process memory 20. When the filter coefficient of the digital filter in the signal processor 2 may be regarded convergent, the the noise control mode is cancelled. Then the filter coefficient used for the signal processor 2 is stored in the process memory 20 to be used for the subsequent system identification mode.

When the noise controller is driven again, it becomes at the system identification mode. Since the filter coefficient obtained during the just previous system identification mode and stored in the process memory 20 is used for the signal processor 22 during this system identification mode, the filter coefficient used for the signal processor 22 can be quickly converged. After the system identification mode, the noise controller becomes the noise control mode. However, since the filter coefficient used for the signal processor 20 which has been calculated during the system identification mode is used for the signal processor 2 during the subsequent noise control mode, the filter coefficient of the digital filter in the signal processor 2 can be quickly converged.

Generally, a noise controller is repeatedly used at the sam position, and thus the filter coefficients used for the signal processors 2 and 22 and other systematic functions seldom vary. Thus, if the filter coefficient calculated in the just previous operation is used for the subsequent operation, the filter coefficient is quickly converged in the subsequent operation and the noise-controllable point is quickly noise-controlled.

Figure 1:
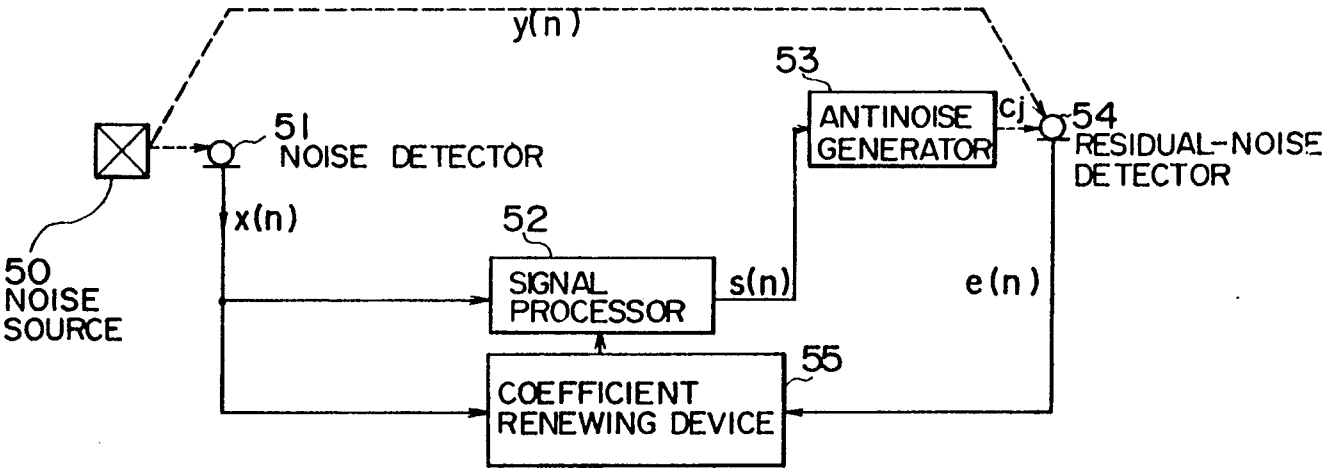
FIG. 1 PRIOR ART
FIG.1 shows a systematic block diagram of a conventional noise controller.
Figure 6:
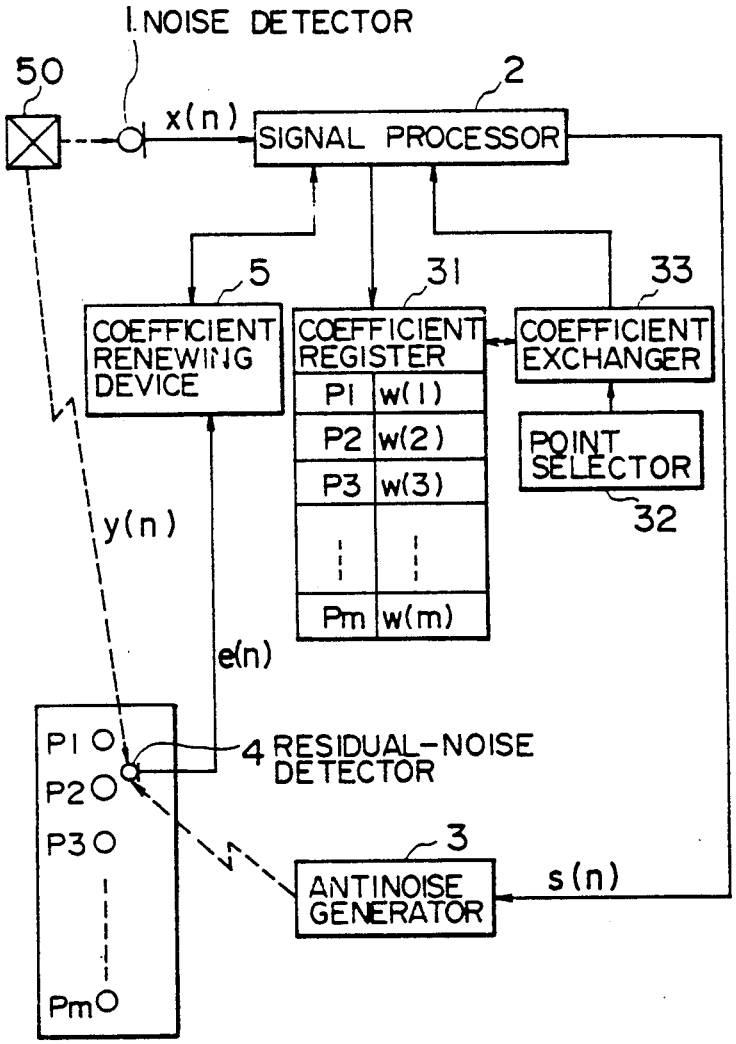
FIG.6 shows a systematic block diagram of a noise controller of a fourth embodiment according to the present invention.

Next follows, with reference to FIG.6, a description of a noise controller of a fourth embodiment according to the present invention. Those elements in FIG.6 which are the same as corresponding elements in FIG.1 are designated by the same reference numerals, and a description thereof will be omitted. In the noise controller of this embodiment, a plurality of filter coefficients used for the signal processor 2 were calculated in advance and stored correlatively with various positions of the noise-controllable point. During the noise control operation, one of the filter coefficients corresponding to the current position of the noise controllable point is selected, and substituted for the filter coefficient of the digital filter in the signal processor 2.

The noise controller shown in FIG.6 includes a coefficient register 31, a point selector 32, and a coefficient exchanger 33.

The coefficient register 6 stores a table, as shown in FIG.6, which correlates a plurality of filter coefficients with various positions Pl to Pm of noise-controllable point where the residual-noise detector 4 is supposed to be located. The table is produced by the coefficient renewing device 5.

The point selector 32 selects on of the positions Pl to Pm of the noise-controllable point closest to the current position thereof. Incidentally, the construction of the point selector 32 will be described later.

The coefficient exchanger 33, coupled to the coefficient register 31, the point selector 32, and the signal processor 2, reads out, from the coefficient register 31, a filter coefficient corresponding to one of the positions of the noise-controllable point specified by the point selector 32, and use it for the digital filter in the signal processor 2. Incidentally, the current position of the noise-controllable point may be calculated by measuring a position of the residual-noise detector 4.

Next follows a description of the noise controller shown in FIG.6.

In advance to the noise control operation, the coefficient renewing device 5 produces the table in which a plurality of filter coefficients w(I) to w(m) used for the signal processor 2 is correlated with various positions Pl to Pm of the noise-controllable points of the residual-noise detector 4. For example, the residual-noise detector 4 is made to be positioned at a position PI of the noise-controllable point, and the coefficient renewing device 4 establishes the corresponding filter coefficient w(1) in accordance with the LMS algorithm. Then the filter coefficient w(I) is stored in the coefficient register 31 while correlated with the position Pl. Similarly, the coefficient renewing device 5 determines the other filter coefficients w(2) to w(m) and stored in the coefficient register 31 while correlating with positions P2 to Pm. Incidentally, various transfer functions $C_j$ between each position of the noise-controllable point and the antinoise generator 3 is be calculated by using a white noise in the system identification method. Thus, the table which correlates various positions Pl to Pm of the noise-controllable point with the filter coefficients w(l) to w(m) are produced and stored in the coefficient register 31, as shown in FIG.6.

Then the noise control operation is performed. First, the point selector 32 selects one of the positions Pl to Pm of the noise-controllable point, and informs the coefficient exchanger 33 of it. If the point selector 32 selects the position Pl, the coefficient exchanger 33 reads out the filter coefficient w(1) corresponding to the position Pl from the coefficient register 6 and exchange it for the current filter coefficient in the signal processor 2. Consequently, the antinoise generator 3 outputs an antinoise which effectively eliminates the noise y(n) at the position Pl. Subsequently, if the point selector 32 selects the position Pm, the filter coefficient w(m) corresponding thereto is selected by the coefficient exchanger 8 and substituted for the filter coefficient w(l). Thus, the antinoise generator 3 outputs the antinoise which effectively eliminates the noise y(n) at the position Pm.

Thus, since, when the noise-controllable point moves the filter coefficient is accordingly corrected, the noise controller can properly noise-controls the movable noise-controllable point. In addition, since the filter coefficient is quickly corrected based on the table stored in the coefficient register 31, the noise controller can noise-control the noise-controllable point more quickly than a noise controller which corrects the filter coefficient based on the LMS algorithm.

Incidentally, the point selector 32 may have various constructions based on the environment to which the noise controller is applied. For example, if an attempt is made to apply the noise controller to a reclining chair in a car, the point selector 32 may be constructed as means for automatically specifying a chair position which changes stepwisely. In this case, various positions of a user's head sitting down the chair defines the noise-controllable point. Only if such a point selector 32 is provided with the noise controller, the user sitting on the chair always feels quiet since the noise controller automatically operates.

Figure 7:
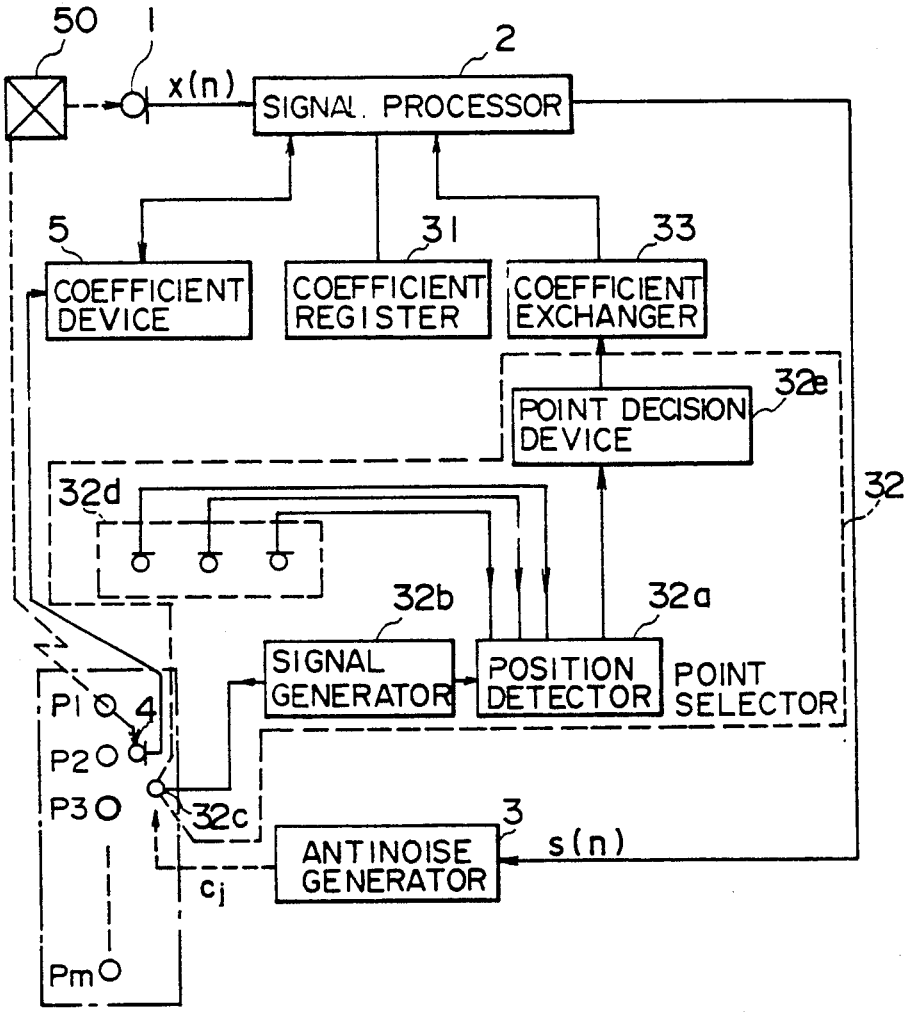
FIG.7 shows a systematic block diagram of the noise controller shown in FIG.6 in which a point selector shown in FIG.6 is concretely depicted.

On the other hand, the point selector 32 may be comprised, as shown in FIG.7. Those elements in FIG.7 which are the same elements in FIG.6 are designated by the same reference numerals, and a description thereof will be omitted. The point selector 32 shown in FIG.7 comprises a position detector **32*a*, a signal generator 32*b*, ultrasonic microphones 32*c* and 32*d*, and a point decision device 32*e*. The position detector 32*a* detects a position of a user's head which is the noise-controllable point. The signal generator 32*b*, coupled to the position detector 32*a*, generates a signal used for the ultrasonic microphone 32*c*. The ultrasonic microphone 32*c*, coupled to the signal generator 32*b*, is located near the user's head, such as a user's ear. The ultrasonic microphones 32*d* includes desirably more than three microphones, so as to detect an ultrasonic output from the ultrasonic microphone 32*c*. The ultrasonic microphones 32*d* are located, for example, spacially above the user's head. The arrangement among the ultrasonic microphones 32*d* is predetermined and input to the position detector 32*a*. The detection result of the ultrasonic microphones 32*d* is input to the position detector 32*a*. The position decision device 32*e*, coupled to the position detector 32*a*, specifies one of positions of the noise-controllable point based on an output of the position detector 32*a***.

Next follows an operation of the point selector 32. When the signal generator **32*b* generates an impulse every predetermined period, the ultrasonic microphone 32*c* outputs, in response, an ultrasonic impulse at a predetermined time interval. Thus, each of the ultrasonic microphones 32*d* detects the ultrasonic impulse. The positioned detector 32*a* measures the propagation time in which the ultrasonic impulse propagates from the ultrasonic microphone 32*c* to the ultrasonic microphones 32*d*, and calculates the position of the ultrasonic microphone 32*c*. Since a number of the microphones 32*d* is more than three, a single position of the microphone 32*c* is specified. When the user's ear position is detected by the position detector 32*a*, the point decision device 32*e* selects one of the positions Pl to Pm of the noise-controllable point, which is closest to the user's ear. The subsequent operations are the same as those described with reference to FIG.6, and a description thereof will be omitted. Incidentally, although the microphone 32*c*** outputs an ultrasonic impulse, it may use a burst wave, a pink noise, or a white noise. In addition, a radio wave may be used instead of an ultrasonic. Further, an infrared rays generator may be attached to a user's head, and an infrared camera may detect an output of the infrared rays generator.

Incidentally, the point selector 32 may simultaneously selects two noise-controllable points close to the detected position of the user's head.

In addition, the present invention can be applied to a plurality of noise sources 50, antinoise generators 3, and residual-noise detectors 4. Moreover, the coefficient renewing device 5 and the point selector 7 may be included in the signal processor 2.

Figure 8:
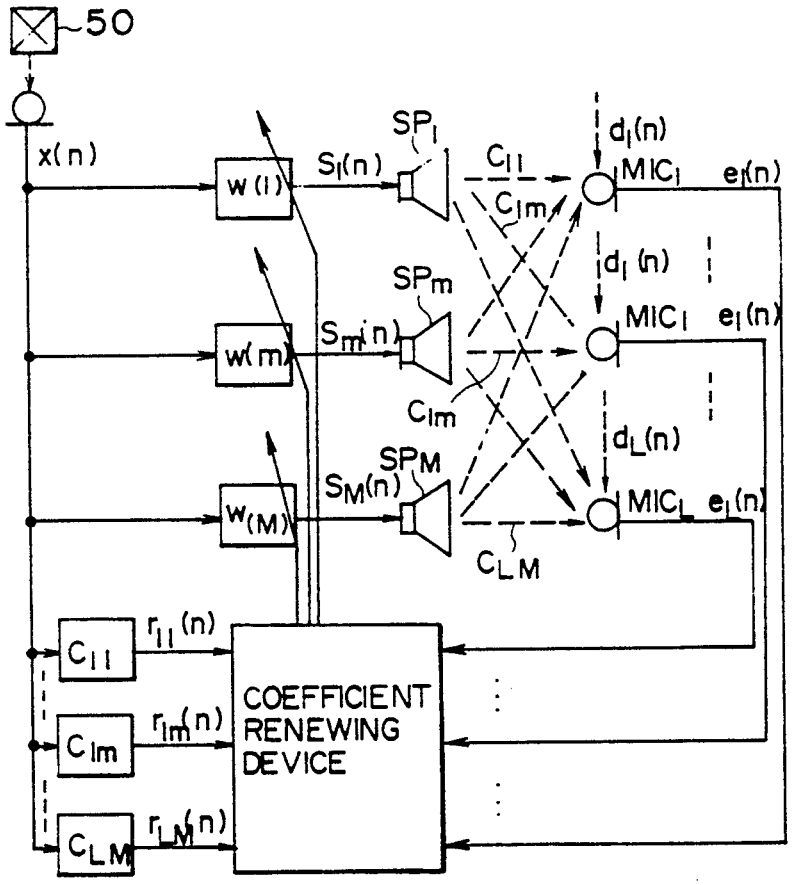
FIG.8 shows a schematic block diagram for explaining a principle of a noise controller of a fifth embodiment according to the present invention.

A description will now be given of a noise controller of a fifth embodiment according to the present invention with reference to FIGS and 9. The antinoise generator of this noise controller includes a plurality of antinoise speakers $SP_m$ ($1 \leqq m \leqq M$) designed to noise-control many noise-controllable points $P_l$ ($1 \leqq l \leqq L$). Thus, since a wide noise-controllable zone defined by a plurality of noise-controllable points $P_l$ can be obtained, only if a current point to be noise-controlled is located within the noise-controllable zone, the noise eliminating effect can be maintained. The current point to be noise-controlled moves within the above zones. FIG.8 shows a schematic block diagram of the noise controller, and FIG.9 shows a systematic block diagram of the noise controller.

Figure 9:
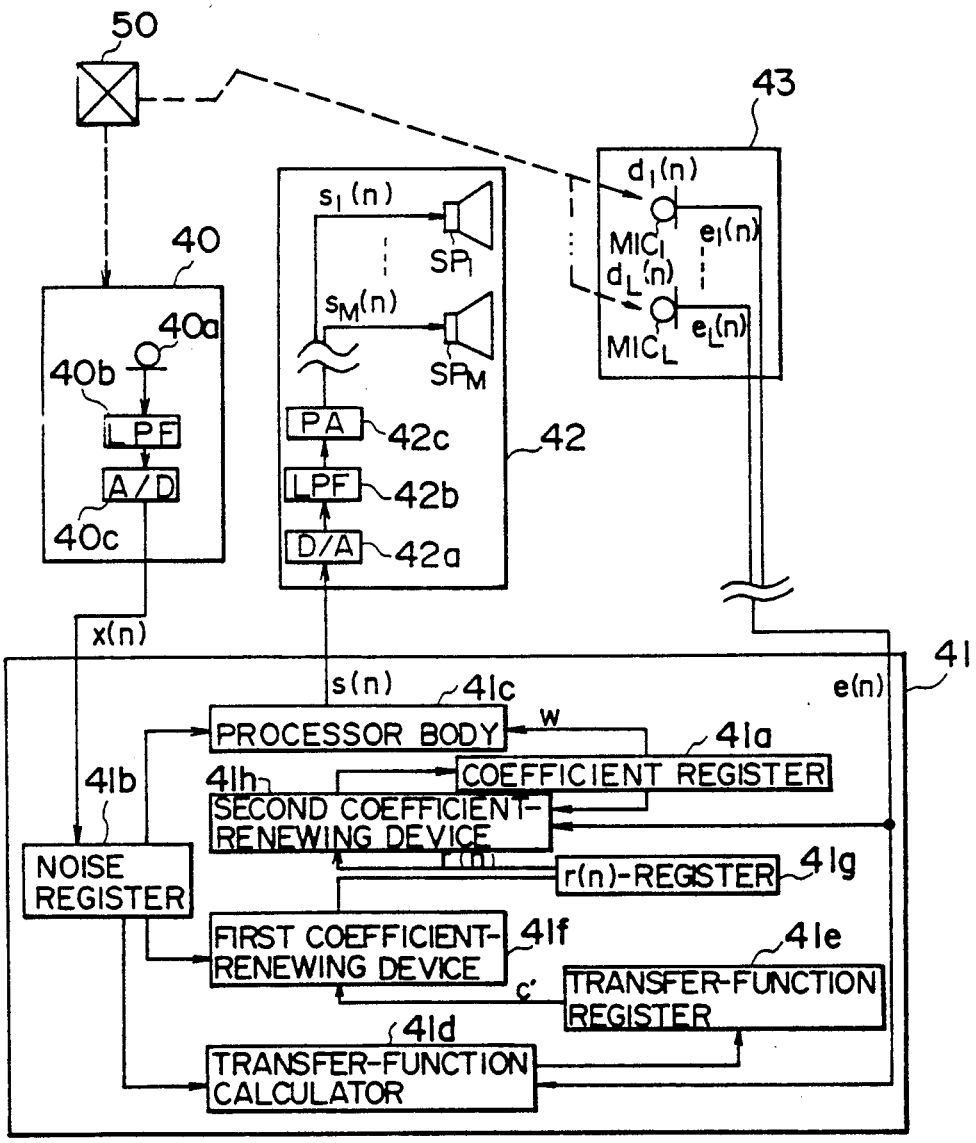
FIG.9 shows a systematic block diagram of the noise controller shown in FIG.8.

The noise controller shown in FIG.9 includes a noise detector 40, a signal processor 41, an antinoise generator 42, and a residual-noise detector 43.

The noise detector 40 corresponds to the noise detector 1, and includes a microphone 40*a* for detecting the noise generated from the noise source 50, a low pass filter (LPF) 40*b* for filtering an output of the microphone 40*a*, and an analog-to-digital converter (A/D) 40*c* for generating the signal x(n) by digitalizing an output of the LPF 40*b*.

The signal processor 41 comprises a coefficient register 41*a*, a noise register 41*b*, an processor body 41*c*, a transfer-function calculator 41*d*, a transfer-function register 41*e*, a first coefficient-renewing device 41*f*, an r(n)-register 41*g*, and a second coefficient-renewing device 41*h*. The signal processor 41 may has a memory having the coefficient register 41*a* and the noise register 41*b* therein. Thus, the signal processor 41 corresponds to the signal processor 2 and the coefficient renewing device 5.

The coefficient register 41*a* stores filter coefficients $w(m)=w_i(m)$ ($0 \leqq i \leqq I-1$, $1 \leqq m \leqq M$) used for a FIR (finite impulse response) filter having a length I accommodated in the processor body 41*c*.

The noise register 41*b*, coupled to the noise detector 40, stores the signal x(n) therein for I periods, that is, $x(n)=x(n-i)$ ($0 \leqq i \leqq I-1$).

The processor body 41*c*, coupled to the coefficient register 41*a*, the noise register 41*b*, and the antinoise generator 42, includes the above FIR filter. The processor body 41*c* signal-processes the signal x(n) stored in the noise register 41*b* via the FIR filter, and outputs signals $s(n)=s_m(n)$ ($1 \leqq m \leqq M$) to the antinoise generator 42.

The transfer-function calculator 41*d*, coupled to the noise register 41*b* and the residual-noise detector 43, receives the signal x(n) from the noise register 41*b* and signals $e(n)=e_l(n)$ ($1 \leqq l \leqq L$) from the residual-noise detector 43, and identifies transfer functions $C'(lm)=C'_j(lm)$ ($0 \leqq j \leqq J-1$) in accordance with the system identification method, that is, LMS method.

The transfer-function register 41*e*, coupled to the transfer-function calculator 41*d*, stores therein the transfer functions $C'_j(lm)$ identified by the transfer-function calculator 41*d*.

The first coefficient-renewing device 41*f*, coupled to the noise register 41*b* and the transfer-function register 41*e*, calculates a term of $$r(n) = \sum_j C_j * x(n - i - j)$$

in the equation (5), by using the signal x(n) stored in the noise register 41*b* and the identified transfer function $C'_j(lm)$ stored in the transfer-function register 41*e*.

The r(n)-register 41*g*, coupled to the first coefficient renewing device 41*f*, stores $r(n)=r_{lm}(n)$ for I periods calculated by the first coefficient-renewing device 41*f*.

The second coefficient-renewing device 41*h*, coupled to the coefficient register 40*a*, the r(n) register 41*g*, and the residual-noise detector 43, receives the signal $e_l(n)$ from the residual-noise detector 43 and $r_{lm}(n)$ from the r(n)-register 41*g*, and generates a new filter coefficient $w_i(m)$ to be used for the FIR filter in the processor body 41*c*.

The antinoise generator 42, corresponding to the antinoise generator 3, includes a digital-to-analog converter (D/A) 42*a*, a LPF 42*b*, a power amplifier (PA) 42*c*, and a plurality of antinoise speakers SPm ($1 \leqq m \leqq M$). The D/A 42*a*, coupled to the processor body 41*c*, converts the digital signal $s_m(n)$ into a corresponding analog signal. The LPF 42*b*, coupled to the D/A 42*a*, filters an output of the D/A 42*a*. The PA 42*c*, coupled to the LPF 42*b*, amplifies an output of the LPF 42*b*. Each of the antinoise speakers $SP_m$ ($1 \leqq m \leqq M$), coupled to the PA 42*c*, outputs the antinoise to the noise-controllable points $P_l$ ($1 \leqq l \leqq L$). Since the antinoise generator 42 includes many antinoise speakers $SP_m$, a wide noise-controllable zone can be obtained. Thus, only if a current point to be noise-controlled is located within the noise-controllable zone, a noise eliminating effect can be actuated.

The residual-noise detector 43, corresponding to the residual-noise detector 4, includes a plurality of microphones $MIC_l$($1 \leqq l \leqq L$) each located at the noise-controllable points $P_l$ ($1 \leqq l \leqq L$). The microphones $MIC_l$ respectively detect residual noises generated from the noises $d_l$ (b $1 \leqq l \leqq L$) from the noise source 50 which are collided with the antinoises from the antinoise speakers $SP_m$. Each of the microphones $MIC_l$ is connected to the transfer-function calculator 41*d* and the second coefficient-renewing device 41*h* in the signal processor 41, so as to feedback the signal $e_l(n)$ to the signal processor 41.

Next follows a operation of the noise controller shown in FIG.9. Incidentally, the current operation is performed at time (n+1) and the just previous operation was performed at time n.

When the microphone 40*a* of the noise detector 40 detects a noise generated from the noise source 50, it converts the noise into the electric signal. Then the electric signal is filtered by the LPF 40*b*, digitalized by the A/D 40*c* to be the signal x(n), and fed to the noise register 41*b* of the signal processor 41.

On the other hand, the residual-noise detector 43 detects the residual-noise signals $e_l(n)$ at the point $P_l$, the residual-noise signals $e_l(n)$ being generated by colliding the antinoise generated during the previous operation, with the noises $d_l$ from the noise source 50. The signals $e_l(n)$ are fed back to the signal processor 41.

The transfer-function calculator 41*d* receives the signal x(n) from the noise register 41*b* and the signals e(n) from the residual-noise detector 43, and identifies transfer functions $C'_j(lm)$ $(0 \leqq j \leqq J-1)$ in accordance with the LMS algorithm. The identified transfer functions $C'_j(lm)$ are stored in the transfer-function register 41e. Then the first coefficient-renewing device 41f receives the identified transfer functions $C'_j(lm)$ from the transfer-function register 41e and the signal x(n) from the noise register 41b, and calculates $r_{lm}(n)$ as follows:

$$r_{lm}(n) = \sum_{j=0}^{J-1} C'_j(lm) * x(n-j) \tag{8}$$

Next, the first coefficient-renewing device 41f stores $r_{lm}(n)$ in the r(n) register 41g.

Subsequent, the second coefficient-renewing device 41h receives the signals $e_l(n)$ from the residual-noise detector 43 and r(n) from the r(n)-register 41g, and renews the previous filter coefficients $w_i(m, n)$ generated during the previous operation as follows:

$$\begin{aligned} w_i(m, n+1) &= w_i(m, n) + \delta w_i(m, n) = \\ &w_i(m, n) - \alpha * \partial E(n)/\partial w_i(m) = \\ &w_i(m, n) - \alpha \sum_{i=1}^{L} e_l(n) * \sum_j C_j(lm) * x(n-i-j) = \\ &w_i(m, n) - \alpha * \sum_{i=1}^{L} e_l(n) * r_{lm}(n-i) \end{aligned} \tag{9}$$

Incidentally, $C_j(lm)$ in the above equation (9) represents actual impulse responses of paths (or transfer functions) between the noise source 50 to the microphones $MIC_1$, however, $C'_j(lm)$ supercedes $C_j(lm)$.

Hereupon, the signals $e_1(n)$ are given, as defined by the equations (1) and (2):

$$e_l(n) = d_l(n) + \sum_{m=1}^{H} \sum_j C_j(lm) s_m(n-j) \tag{10}$$

$$Sm(n) = \sum_{i=0}^{I-1} w_i(m) * x(n-i) \tag{11}$$

After the second coefficient-renewing device 41h renews the filter coefficient $w_i(m, n+1)$ used for the FIR filter in the processor body 41c, the renewed filter coefficients $w_i(m, n+1)$ is once stored in the coefficient register 41a and then fed to the processor body 41c. The processor body 41c receives the signal x(n) to signal-processes it by means of the FIR filter having the renewed coefficients, and generates the signals $s_m(n)$.

When the D/A 42a of the antinoise generator 42 receives the signals $s_m(n)$ from the processor body 41c, it converts the signals $s_m(n)$ into the corresponding analog signal. The LPF 42b then receives the analog signal to filter it out, and output the signal to the PA 42c. Thus, the filtered analog signal is amplified by the PA 42c, and then fed to the respective antinoise speakers $SP_m$.

Incidentally, in the equation (9), to obtain desired filter coefficient which makes a sound pressure as small as possible at the point to be noise-controlled, the filter coefficient is determined so that a square error E(n) defined as follows can be minimized:

$$E(n) = E\{e_1(n)\}^2 \tag{12}$$

, where E[·] represents an average. From the equations (10) to (12), E(n) can be regarded as a secondary equations of $w_i(m)$. Since a matrix which determines a secondary coefficient is positive semidefinite, however generally positive definite, only one $w_i(m)$ which minimizes E(n) can be obtained.

In addition, if a system acoustic environment seldom changes, a fixed filter coefficient of the FIR filter in the processor body 41c may be used in a normal operation of the noise controller. In this case, only if the filter coefficient may be renewed once before the operation, the filter coefficient can be fixedly used for the noise controller during the subsequent operations. As a result, the noise controller needs not generate a new filter coefficient, and needs no residual-noise detector 43.

A description will now be given of a first example of an improved noise controller shown in FIG.9, with reference to FIGS.10 to 13. In the noise controller shown in FIG.9, the number of necessary filtering operations is proportional to the multiplication between the number of the points $P_l$ and the number of antinoise speakers $SP_m$. In addition, an operation of the noise controller shown in FIG.9 comprises a plurality of multiplicative digital operations and additional digital operations. Thus, if many noise-controllable points $P_l$ and many antinoise speakers $SP_m$ are used, the noise controller shown in FIG.9 must inconveniently operate many times and impractically needs many hardwares for the digital operations. Concretely, the noise controller shown in FIG.9 must operate M*(L+1) times regarding I in accordance with the equations (9) and (11), and L*M times regarding J in accordance with the equation (8). If I=J, the noise controller shown in FIG.9 must operate (2L+1)*M times. Accordingly, it is an aim of the noise controller shown in FIG.10 to noise-control a wide range via a practical number of hardwares.

Figure 10:
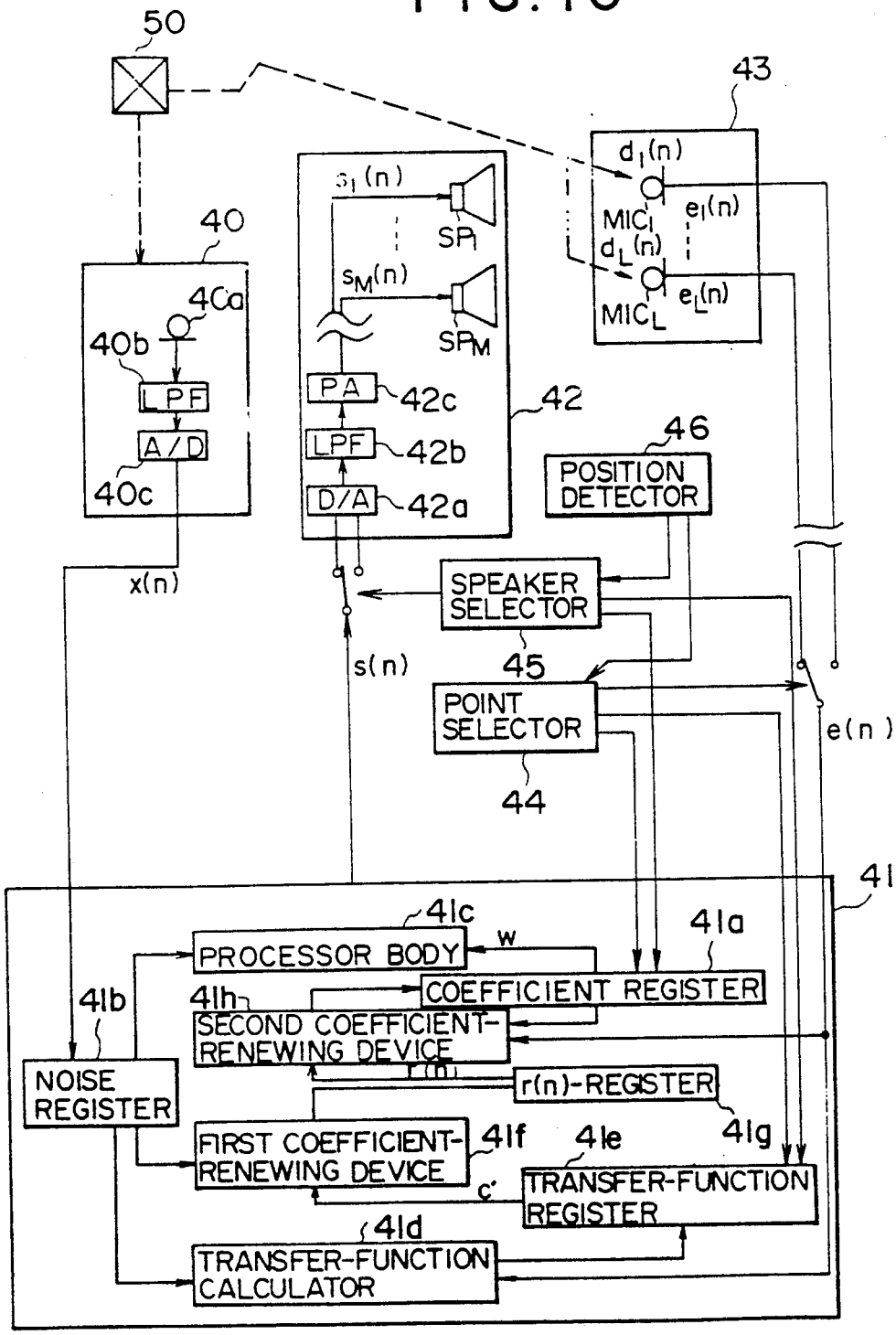
FIG.10 shows a systematic block diagram of a first example of an improved noise controller shown in FIG.9.

The noise controller shown in FIG.10 includes a point selector 44, a speaker selector 45, and a position detector 46. Those elements in FIG.9 which are the same corresponding elements in FIG.10 are designated by the same reference numerals, and a description thereof will be omitted.

Figure 11:
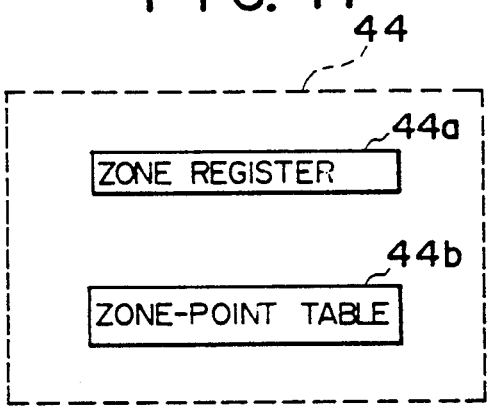
FIG.11 shows a block diagram of a point selector of the noise controller shown in FIG.10.

The point selector 44, coupled to the residual-noise detector 43, selects one or more noise-controllable points for the current noise-control operation from among the points $P_l$ $(1 \leqq l \leqq L)$. Actually, the point selector 44 selects one or more responsible microphones $MIC_l$ in the residual-noise detector 43. The point detector 44 includes, as shown in FIG.11, a zone register 44a and a zone-point table 44b. The zone register 44a stores a coordinate criterion which specifies each noise-controllable zone. The zone-point table 44b correlates noise-controllable zones with responsible noise-controllable points. Due to the zone-point table 44b, when a zone is specified, the responsible noise-controllable points $P_l$ are accordingly specified. As mentioned below, each zone is noise-controlled by a plurality of responsible points $P_l$ which respectively enclose the zone.

Figure 12:
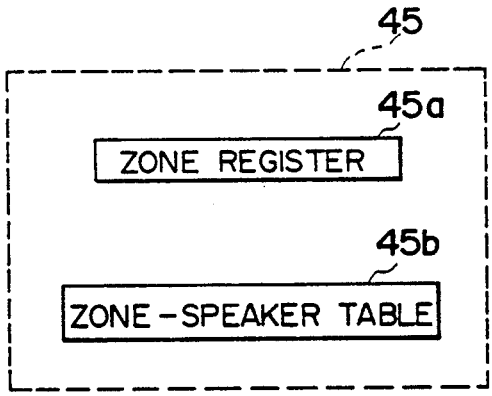
FIG.12 shows a block diagram of a speaker selector of the noise controller shown in FIG.10.

The speaker selector 45 selects one or more responsible antinoise speakers from among the antinoise speakers $SP_m$ $(1 \leqq m \leqq M)$, which relate to the selected noise-controllable points. The speaker selector 45 includes, as shown in FIG.12, a zone register 45a and a zone-speaker table 45b. The zone register 45a is the same as the zone register 44a, and a description thereof will be omitted. The zone-speaker table 45b correlates noise-controllable zones with responsible antinoise speakers $SP_m$. Due to the zone-speaker table 45b, when one noise-controllable zone is specified, the responsible speakers $SP_m$ are accordingly specified. As mentioned below, each noise-controllable zone is noise-controlled by a plurality of antinoise speakers $SP_m$.

The position detector 46, coupled to the point selector 44 and the speaker selector 45, specifies one of the noise-controllable zones, as a space or area to be currently noise-controlled within which a user's head moves, and outputs the position data to the point selector 44 and the speaker selector 45. Thus, it may be said that the position detector 46 indirectly detects the position of the user's head. The position detector 46 may use an ultrasonic or a radio wave. In addition, an infrared rays generator may be attached to the user's head. In this case, the position detector comprises an infrared camera detects an RGB output of the infrared rays generator, A/D-converts an R (red) output to obtain a multivalued digital image, and extracts pixels from the image, which have values more than a predetermined threshold, since the red light source corresponds to the user's head.

Figure 13:
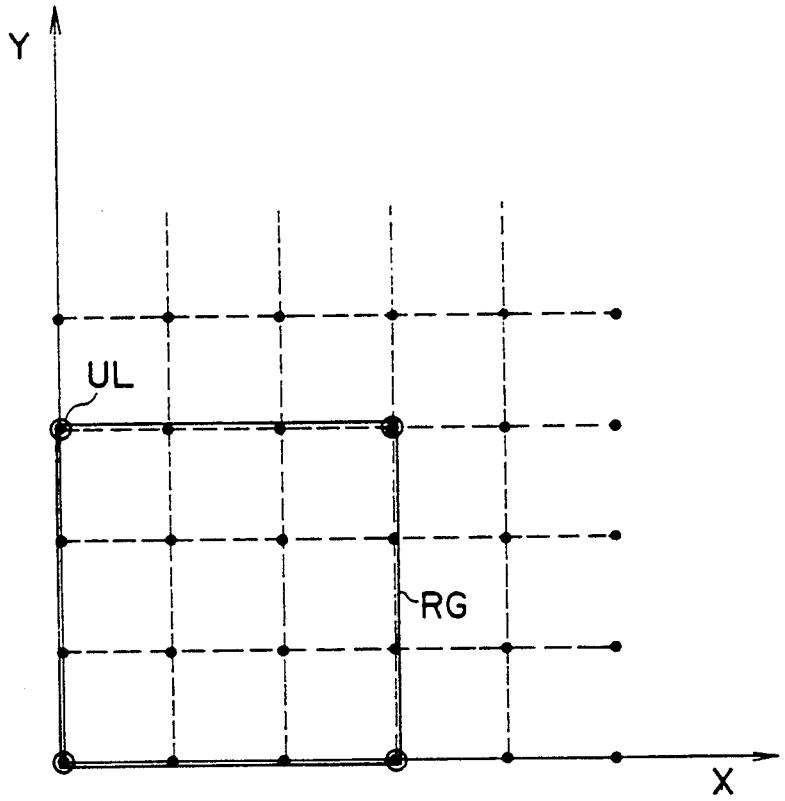
FIG.13 shows a coordinate, used for the noise controller shown in FIG.10, which defines a noise-controllable zone.

Next follows, with reference to FIG.13, a description of an operation of the noise controller shown in FIG.10. Initially, it is assumed that a noise-controllable zone consists of a space defined by a virtual two-dimensional X-Y coordinate shown in FIG.13, and a predetermined height (not shown). Then, the X-Y coordinate is segmented into a plurality of contiguous same squares. Four corners of each basic square is the noise controllable points responsible for the square. In addition, four antinoise speakers located points UL above four corners of a square comprising nine basic squares. Thus, as shown in FIG.13, since an antinoise speaker located above a boundary of two adjacent squares is commonly used, the number of antinoise speakers can be saved in comparison with a case where antinoise speakers are used for each corner of each square. Incidentally, the zone division and the arrangement of the antinoise speakers and responsible noise-controllable points are merely examples. However, the following method can be applied to another type of division and another arrangement.

It is assumed that M' represents the number of noise-controllable points responsible to each noise-controllable zone and L' represents the number of antinoise speakers responsible for each noise-controllable zone. Now, $M'=L'=4$. In addition, it is assumed that T represents the total number of noise-controllable zones, L represents the total number of noise-controllable points, and M represents the total number of antinoise speakers. Each noise-controllable zone has an identification number t ($1 \leqq t \leqq T$). In addition, an arbitrary noise-controllable point is expressed by $P_l$ ($1 \leqq l \leqq L$), whereas an arbitrary antinoise speaker is expressed b $SP_m$ ($1<m<M$). Moreover, it is assumed that P(t, u) ($1<u<L'$) represents noise-controllable points responsible for a noise-controllable zone t, and SP(t, v) ($1 \leqq v \leqq M'$) represents antinoise speakers responsible for the noise-controllable zone t.

The signal processor 41 includes one input terminal NS for receiving the noise signal x(n), L' number of input terminals u ($1<u<L'$) for receiving, if any, the signal e(n) from residual-noise detector 43, and M' number of output terminals v ($1<v<M'$) for outputting the signal s(n) to the antinoise generator 42. Since the processor body 41c must filter the noise signal x(n) stored in the noise register 41b and control SP(t, v) ($1 \leqq t<T$, $1<v<M'$), the processor body 41c needs T*M' number of filter coefficients $w(t, v)=w_i(t, v)$ ($0 \leqq i<I-1$) ($1 \leqq t<T$, $1 \leqq M'$).

Each of the zone registers 44a and 44b stores a X-Y coordinate criterion which defines boundaries of each noise-controllable zone t. For example, if boundaries defining an arbitrary noise-controllable zone t have X-Y coordinate criteria ($a_t \leqq X \leqq b_t$, $c_t \leqq Y \leqq d_t$), each of the zone registers 44a and 44b stores data of $[(a_t, b_t), (c_t, d_t)]$.

The zone-point table 44b in the point register 44 receives an identification number t of each noise-controllable zone, and, in response, generates an identification number 1 ($1 \leqq 1 \leqq L$) of the points P(t, u) ($1 \leqq u \leqq L'$). The zone-speaker table 45b in the speaker selector 45 receives an identification number t of each noise-controllable zone, and, in response, generates an identification number m ($1 \leqq m \leqq M$) of the antinoise speakers SP(t, v) ($1 \leqq v \leqq M'$).

During an initial operation, the signal processor 41 generates a signal with a restricted frequency band-width which includes a frequency band-width of the noise generated from the noise source 50, such as a white noise, via a signal generator (not shown) installed therein, and then outputs the signal via one of the antinoise speakers $SP_m$. The signal is fed to the transfer-function calculator 41d, and transmitted to the microphones $MIC_1$ in the residual-noise detector 43 to be feed back as the signal e(n) to the transfer-function calculator 41d. Then the transfer-function calculator 41d calculates the transfer function C'(lm) and stores it in the transfer-function register 41e.

When the point selector 44 receives the position data of each noise-controllable zone (X, Y) from the position detector 46, it reads out the coordinate criteria of each of the noise-controllable zones ($a_t$, $b_t$) and ($c_t$, $d_t$) from the zone register 44a to perform inequality operations, $a_t \leqq X \leqq b_t$ and $c_t \leqq Y \leqq d_t$. If both the inequality equations are true, the point selector 44 specifies the zone's identification number t. In the same manner, the speaker selector 45 specifies the zone's identification number t.

When the noise-controllable zone t is specified by the point selector 44 and the speaker selector 45, the identification number t is fed to the signal processor 41. In addition, the point selector 44 calculates the identification numbers 1(1), 1(2), 1(3) and 1(4) via the zone-point table 44b and outputs it to the signal processor 41. The speaker selector 45 calculates the identification numbers m(v) ($1 \leqq v \leqq M$,) via the zone-speaker table 45b, so as to connect the output terminals v of the signal processor 41 to the antinoise speakers $SP_m(v)$, and so as to output the identification number m(v) to the signal processor 41.

The processor body 41b in the signal processor 41 reads out a filter coefficient w(t, v) corresponding to the specified zone identification number t, from the coefficient register 41a, and filters the signal x(n) to generates the signal $s(n)=s_{mv}(n)$ defines as follows:

$$s_{mv}(n) = \sum_{i=0}^{I-1} w_i(t, v) * x(n-i) \tag{13}$$

Next follows a description of how to determine the filter coefficient w(t, v).

Initially, the signal processor 41 generates a signal with a restricted frequency band-width which includes a frequency band-width of the noise to be controlled, such as a white noise, via a signal generator (not shown)

installed therein, and then outputs the signal via one of the antinoise speakers SP(t, v). The signal is fed to the transfer-function calculator 41*d*, and transmitted to the microphones $MIC_1$ in the residual-noise detector 43. The point selector 44 connects the output of the microphones $MIC_1(v)$ in the residual-noise detector 43 to the input terminals u of the signal processor 41. Then the transfer-function calculator 41*d* calculates the transfer function $C'_{1(u)m(v)}$ and stores it in the transfer-function register 41*e*. Next, the first coefficient-renewing device 41*f* calculates $r_{uv}(n)$ as follows, and stores it in the r(n)-register 41*g*:

$$r_{uv}(n) = \sum_{j=0}^{J-1} C'_{k(u)m(v)} * x(n-j) \tag{14}$$

The second coefficient-renewing device 41*b* then renews the filter coefficient $w_i(t, v; n)$ as follows, and stores it in the coefficient register 41*a*:

$$w_i(t, v; n+1) = w_i(t, v; n) - \alpha \sum_{u=1}^{L} e_{k(u)}(n) r_{uv}(n-i) \tag{15}$$

Incidentally, the zone identification number t is sequentially increased from 1 to T in the above operations.

In addition, if a system acoustic environment seldom changes, the filter coefficient may be fixed during the normal operation of the noise controller. In this case, the filter coefficient may be renewed once before the operation, and a sufficiently-convergent filter coefficient may be used for the noise controller. As a result, the noise controller needs not generate a new filter coefficient, and needs no residual-noise detector 43.

Thus, in the noise controller shown in FIG.10, since the position detector 46 restricts the range of the current noise-controllable zone, the number of operations performed by the signal processor 41 can be saved irrespective of the wide noise-controllable zone.

Although in the above example, the noise control operation is performed for every zone, it may be performed for every noise-controllable point. In addition, the point selector 44 and the speaker selector 45 may be alternative if there are a plurality of antinoise speakers and on noise-controllable point or if there are one antinoise speaker and a plurality of noise-controllable points. Moreover, if the user's head stepwisely moves, for example, in a reclining chair of a car, the position detector 46 may be omitted since an inclined angle of the chair is predetermined. Furthermore, the position detector 46 may detect the existence of a user. If the position detector 46 detects no user, it may transmits a signal "0" to the speaker selector 45 so as to stop the operation of the antinoise speakers $SP_m$. Consequently, a waste operation of the noise controller and power boost thereof can be prevented. In this case, the position detector 46 may be comprises the aforementioned infrared rays detector, the ultrasonic receiver, or the like.

A description will now be given of a second example of an improved noise controller shown in FIG.9, with reference to FIGS.14 to 17. In the noise controller shown in FIG.9, if the number L of the noise-controllable points becomes large, it takes much time to calculate a transfer function for each noise-controllable point in accordance with the system identification method and thus it is difficult to quickly noise-control a desired point. Accordingly, it is an aim of the noise controller shown in FIG.14 to quickly obtain the transfer function to quickly noise-control a desired point.

Figure 14:
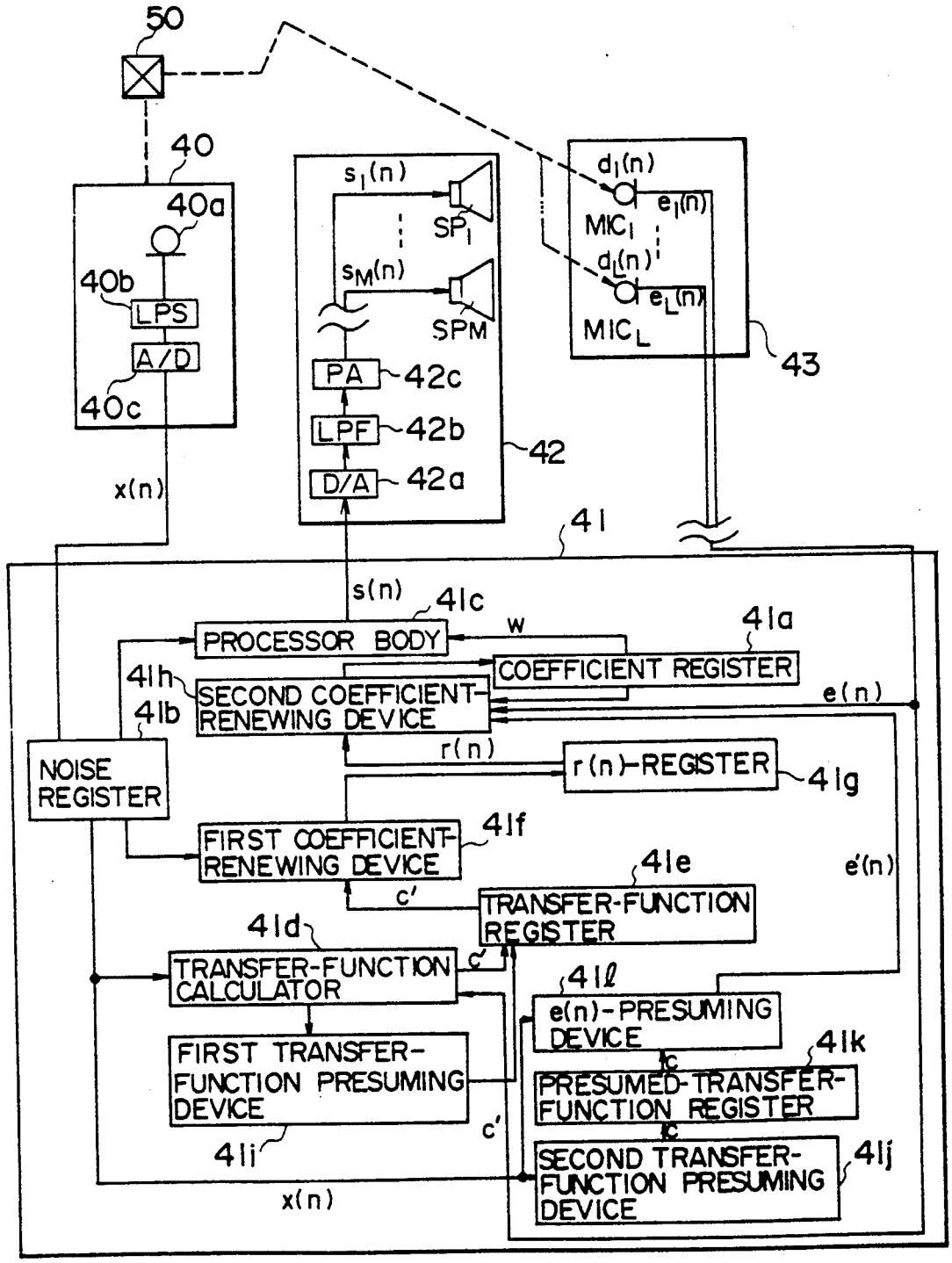
FIG.14 shows a systematic block diagram of a second example of an improved noise controller shown in FIG.9.
Figure 15:
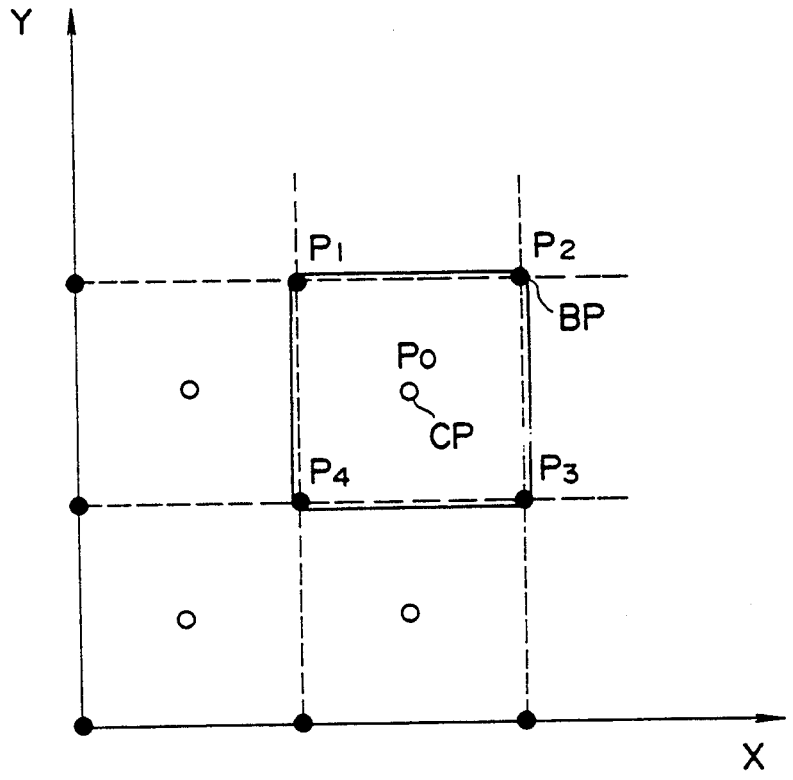
FIG.15 shows a coordinate, used for the noise controller shown in FIG.15, which defines a noise-controllable zone.

According to the noise controller shown in FIG.14, the noise-controllable points classified, as shown in FIG.15, into fixed points BP and virtual points CP. If a noise-controllable point belongs to a fixed point BP, the transfer function is obtained in accordance with the aforementioned system identification method. On the other hand, if a noise-controllable point belongs to a virtual point CP, the transfer function is obtained by operating the pertinent data of the fixed points. Thus, according to the noise controller shown in FIG.14, since all the transfer function are not identified, the average identification time of the transfer function of the noise controller shown in FIG.14 is shorter than that of the noise controller shown in FIG.9.

The noise controller shown in FIG.14 is different from the noise controller shown in FIG.9 in that the signal processor 41 of the noise controller shown in FIG.14 further comprises a first transfer-function presuming device 41*i*, a second transfer-function presuming device 41*j*, a presumed-transfer-function register 41*k*, and a e(n)-presuming device 411. Incidentally, those elements in FIG.14 which are the same as corresponding elements in FIG.9 are designated by the same reference numerals, and a description thereof will be omitted.

The transfer-function presuming device 41*i*, coupled to the transfer-function calculator 41*d* and transfer-function register 41*e*, presumes transfer functions C'j(lm) between the antinoise speakers $SP_m$ and the virtual points CP, based on the transfer functions between the antinoise speakers $SP_m$ and the pertinent fixed points BP.

The second transfer-function presuming device 41*j*, coupled to the noise register 41*b* and the residual-noise detector 43, presumes transfer functions $g_i(1)$ between the noise source 50 and the virtual points CP, based on the transfer functions between the noise source 50 and the pertinent fixed points BP. That is because the noise signal $d_1(n)$ must be modified if a noise-controllable point changes from a fixed point to a virtual point. Thus, the signals $d_i(n)$ can be applied only to the fixed points BP.

The presumed-transfer-function register 41*k*, coupled to the second transfer-function presuming device 41*j*, stores therein the transfer function $g_i(n)$ presumed by the second transfer-function presuming device 41*j*.

The e(n)-presuming device 411, coupled to the noise register 41*b*, second coefficient-renewing device 41*h* and the presumed-transfer-function register 41*k*, presumes the signal e,(n) to be output from a microphone located at a virtual point, based on the transfer function gi(1) stored in the presumed-transfer-function register 41*k*. When the e(n)-presuming device presumes the signal e'(n), it outputs it to the second coefficient-renewing device 41*h*.

A detailed description will now be given of how the filter coefficient regarding the virtual point CP is renewed.

First, a description will now be given of the operation of the first transfer-function presuming device 41*i*.

As shown in FIG.15, the zone to be noise-controlled is segmented into adjacent squares, as is the same in FIG.13. Each fixed point BP is allotted to each corner of each square, whereas each virtual point CP is located at an arbitrary point within each square. Now, as shown in FIG.15, four fixed points ($P_1$, $P_2$, $P_3$ and $P_4$) and one virtual point ) are noted. Conveniently, it is assumed that the virtual point $P_0$ is located at the center of the fixed points $P_1$ to $P_4$.

First, the transfer functions $C'_j(lm)$ ($0 \leqq j \leqq J-1$) between the antinoise speaker $SP_m$ ($1 \leqq m \leqq M$) and the fixed points $P_l$ ($1 \leqq l \leqq 4$) are calculated by the transfer-function calculator 41d, in accordance with the aforementioned system identification method. Thus, each microphone $MIC_l$ of the residual-noise detector 43 is located at each fixed point $P_l$. The identified transfer functions $C'_j(lm)$ are stored in the transfer-function register 41e.

Next, the first transfer-function presuming device 41i presumes the transfer function between the antinoise speakers $SP_m$ and the virtual point $P_0$.

Figure 16:
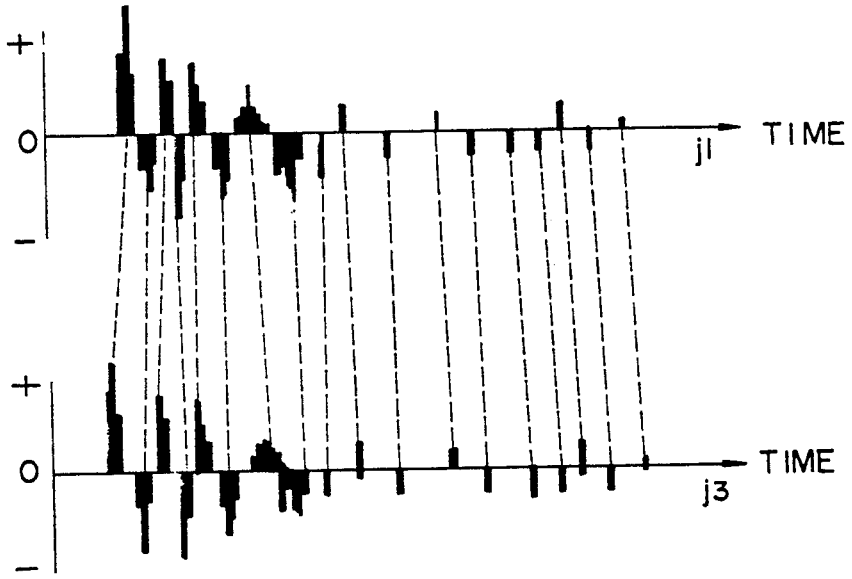
FIG.16 shows impulse responses used for an operation of the noise controller shown in FIG.14.

Now, it is assumed that the impulse response representing the transfer functions $C'_j(l=1, 3)$ ($l=1, 3$) identified by the transfer-function calculator 41d respectively are depicted as shown in FIG.16. Incidentally, in FIG.16, an arrow direction corresponds to elapsed time, and a direction orthogonal to the arrow direction corresponds to a polar of an amplitude of each wave. Since the impulse response represents the sound wave propagating from the antinoise speakers $SP_m$ to the fixed points $P_l$ ($l=1, 3$), these waves shown in FIG.16 respectively may be considered as reflected waves incoming to the fixed points $P_l$ ($l=1, 3$). Accordingly, the first transfer presuming device 41i compares $C'_j(lm)$ with $C'_j(3m)$ to match these reflected waves so that the following function F can be minimized:

$$F=[j1*C'_j(1m)-j3*C'_{j3}(3m)]^2 \tag{16}$$

where j1 represents j regarding the fixed point $P_1$ and j3 represents j regarding the fixed point $P_3$. Each broken line represents a matching pair of j1 and j3. Incidentally, this operation may be performed in accordance with a dynamic programming (DP) matching method. In the equation (16), each transfer function is multiplied by j so as to normalize the transfer function so that a damping of the sound wave can be inverse proportional to a distance. Each matching pair (j1, j3) shown in FIG.16 is stored in a table in the first transfer-function presuming device 41i. Next, the following equation is used to presume the transfer function $C'_{j0}(Om)$:

$$j0=(j1+j3)/2 \tag{12}$$

Thus, j0 ($0 \leqq j \leqq J0-1$) is determined from the table in the first transfer-function presuming device 41i. Incidentally, since j0 represents j regarding the virtual point $P_0$, j0 must be an integer. In addition, there are a plurality of matching pairs (j1, j3) which respectively give the same j0. For example, if the matching pair (j1, j3)=(3, 3), (4, 2), (6, 5), . . . , a matching pair (j0, j1, j3)=(3, 3, 3). A matching pair (j0, j1, j3)=(5.5, 6, 5) is omitted since j0 is not an integer. In addition, to determine only one pair (j1, j3) for one value of j0, a matching pair (j0, j1, j3)=(3, 4, 2) is omitted. Thus, in this example, if there are a plurality of matching pairs (j1, j3) which respectively give the same j0, the matching pair (j1, j3) which has the minimum j1 is selected. However, another judging method may be applied only if only one pair (j1, j3) for one value of j0 can be determined. Incidentally, in the equation (17), since the $P_0$ is located at a middle point between points $P_1$ and $P_3$, j0 is calculated by dividing (j1+j3) by 2 so as to extract the middle time lag. Thus, for each j0 ($0 \leqq j \leqq J-1$), only one pair (j1, j3) can be determined. The similar operation is performed for $C'_j(2m)$ and $C'_j(4m)$, so as to determine only one pair (j2, j4) for each j0. Next, the first transfer-function presuming device 41i presumes $C'_j(Om)$ as follows:

$$C'_j(0m)=[(j0/j1)*C'_{j1}(lm)+(j0/j2)*C'_{j2}(2m)+(j0/j3-)*Cj3(3m)+(j0/j4)*C'_{j4}(4m)]/4 \tag{18}$$

The first transfer-function presuming dvice 41i stores the presumed transfer function $C'_{j0}(Om)$ in the transfer-function register 41e.

Next follows a description of the operation of the second transfer-function presuming device 41j. Initially, the second transfer-function presuming device 41j identifies transfer functions $G_1=g_i(1)$ ($0 \leqq i \leqq I-1$) between the noise source 50 and the fixed points BP, and stores them in the presumed-transfer-function register 41k. Subsequently, the second transfer-function presuming device 41j presumes the transfer functions $g_i(1)$ between the noise source 50 and the virtual point CP in the manner similar to that used to presume the transfer function $C'_{j0}$, and stores them in the presumed-transfer-function register 41j.

Next follows a description of the operation of the e(n)-presuming device 411. The e(n)-presuming device 411 presumes a signal $e'_1(n)$ used to calculate the filter coefficient, based on the $g_i(1)$ stored in the presumed-transfer-function register 41k.

If the noise-controllable point $P_1$ is the fixed point, since the actual microphones are located at the point $P_1$, the e(n)-presuming device 411 uses the signal $e_i(n)$, which was actually output from the microphone, for the signal $e'_i(n)$:

$$e'_i(n)=e_i(n) \tag{19}$$

On the other hand, if the noise-controllable point $P_1$ is the presumption point, since no microphone is located at the point $P_1$, the e(n)-presuming device 411 presumes an signal $e'_i(n)$ to be output from a virtual microphone located at the point $P_1$ as follows:

$$e'_i(n) = d'_i(n) + \sum_{m=1}^{H} \sum_{j=0}^{J-1} C'_j(lm) * s_m(n-j) \tag{20}$$

$$d'_i(n) = \sum_{i=0}^{I-1} g_i(l) * x(n-l) \tag{21}$$

When the e(n)-presuming device 411 calculates $e'_1(n)$, it outputs $e'_i(n)$ to the second coefficient-renewing device 41h. In response, the second coefficient-renewing device 41h uses $e'_i(n)$ to renew the filter coefficient $w_i(m, n)$ as follows:

$$w_i(m, n+1) = w_i(m, n) - \alpha \sum_{i=1}^{L} e'_i(n) * r_{lm}(n-1) \tag{22}$$

When the filter coefficient is convergent, the second coefficient-renewing device 41h stores it in the coefficient register 41a.

Thus, according to the noise controller shown in FIG.14, since the transfer function regarding a virtual point CP is presumed instead of actually identified, time can be saved. As a result, the noise control can be quickly performed at a desired point.

Incidentally, the noise controller shown in FIG.14 is applicable to a case of a plurality of noise-controllable points and one antinoise speaker and a case of one noise-controllable point and a plurality of antinoise speakers.

Further, the present invention is not limited to these preferred embodiment, and a various variations and modifications may be made without departing from the scope of the present invention.

What is claimed is:

1. A noise controller which noise-controls a movable point so that noise generated from a noise source and transmitted to the movable point can be reduced, said noise controller comprising:

a) noise detecting means, located near the noise source, for detecting the noise, and for generating a first signal representing the noise;

b) signal processing means including a digital filter which has a filter coefficient, coupled to said noise detecting means, for generating a second signal by signal-processing the first signal via the digital filter;

c) antinoise generating means, coupled to said signal processing means, for (1) generating an antinoise from the second signal and for (2) outputting the antinoise to the movable point so as to cause the antinoise to collide with the noise;

d) residual-noise detecting means, located at the movable point, for detecting residual noise generated from the noise which was made to collide with the antinoise, and for generating a third signal representing the residual noise;

e) position detecting means for detecting a position of the movable point; and f) coefficient renewing means, coupled to said residual-noise detecting means and responsive to said position detecting means, for renewing the filter coefficient of the digital filter in said signal processing means based on the position of the movable point detected by the position detecting means so that the movable point can be properly noise-controlled even when the movable point moves, said coefficient renewing means renewing the filter coefficient in accordance with a least mean square algorithm in which the filter coefficient is renewed so that a squared third signal can be minimized.

2. A noise controller according to claim 1, wherein said coefficient renewing means renews the filter coefficient in accordance with a least mean square algorithm by using a transfer function between the antinoise generating means and the movable point, and said noise controller further comprises transfer-function correcting means, coupled to said position detecting mean and said coefficient renewing means, for calculating the transfer function used for said coefficient renewing means based on the position of the movable point detected by said position detecting means.

3. A noise controller according to claim 2, wherein said transfer-function correcting means calculates the transfer function in accordance with a system identification method.

4. A noise controller according to claim 3, wherein said position detecting means detects the position of the movable point at a predetermined sampling frequency, and expresses the position of the movable point as a distance between said antinoise generating means and said residual-noise detecting means, and wherein said transfer-function correcting means calculates the transfer function as follows:

$$c_j(n)=L^0/L(n))*C_{j-d}^0;$$

$$d=(L(n)-L^0)*(s_f/v_s),$$

where $C_j(n)$ represents said transfer function, L(n) represents said distance, $C^0$ represents an initial value of $C_j(n)$, $L^0$ represents an initial value of L(n), $s_f$ represents said predetermined sampling frequency, and $v_s$ represents a sound speed.

5. A noise controller according to claim 2, further comprising a transfer-function register, coupled to the transfer-function correcting means, which stores a table for correlating a plurality of positions of the movable point with a plurality of transfer functions, the transfer-function correcting means reading out, from the table in the transfer-function register, one of the transfer functions correlated with one of the positions of the movable part, which is the closest to the position of the movable point detected by the position detecting means.

6. A noise controller according to claim 1, wherein said position detecting means includes:

ultrasonic generating means, coupled to the antinoise generating means, for generating an ultrasonic wave; and ultrasonic sensing means, coupled to the residual-noise detecting means, for receiving the ultrasonic wave from the ultrasonic generating means, the position of the movable point being expressed by a time interval in which the ultrasonic transmits from the ultrasonic generating means to the ultrasonic sensing means.

7. A noise controller according to claim 6, wherein the ultrasonic generating means comprises four ultrasonic generators.

8. A noise controller which noise-controls a predetermined point so that noise generated from a noise source and transmitted to the predetermined point can be reduced, said noise controller comprising:

a) noise detecting means, located near the noise source, for detecting the noise, and for generating a first signal representing the noise;

b) first single processing means including a first digital filter which has a filter coefficient, coupled to said noise detecting mean, for generating a second signal by signal-processing the first signal via the first digital filter;

c) antinoise generating means, coupled to said first signal processing means, for (1) generating an antinoise from the second signal and for (2) outputting the antinoise to the predetermined point so as to cause the antinoise to collide with the noise;

d) residual-noise detecting means, located at the movable point, for detecting a residual noise generated from the noise which was made to collide with the antinoise, and for generating a third signal representing the residual noise;

e) position detecting means for detecting a position of the movable point;

f) process memory means, coupled to said first signal processing means, for storing therein a just previously renewed filter coefficient; and g) first coefficient renewing means, coupled to said residual-noise detecting means, said position detecting means, and said process memory means, for renewing, while converging, the filter coefficient of the first digital filter in accordance with a least mean square algorithm, by using the just previously renewed filter coefficient stored in said process memory so as to quickly converge the filter coefficient, in which least means square algorithm the filter coefficient of the first digital filter is renewed so that a squared third signal can be minimized.

9. A noise controller according to claim 8, further comprising:

signal generating means, coupled to said antinoise generating means, for generating a white noise said antinoise generating means generating an antinoise defined by said white noise, and said residual-noise detecting means detecting the antinoise defined by the white noise, and for generating a fourth signal representing the antinoise defined by the white noise;

second signal processing means including a second digital filter which has a filter coefficient, coupled to said signal generating means, for generating a fifth signal by signal-processing the white noise generated from said signal generating means;

comparing means, coupled to said residual-noise detecting mean and said second signal processing means, for comparing the fourth signal with the fifth signal; and second coefficient renewing means, coupled to said comparing means and said second signal processing means, for receiving a comparison result of said comparing means, and for renewing the filter coefficient of the second digital filter in said second signal processing means so that the fourth signal can be equal to the fifth signal, the filter coefficient renewed by said second coefficient renewing means being stored in said process memory means to be used for the first digital filter.

10. A noise controller according to claim 1, further comprising:

coefficient register means, coupled to said signal processing means, for storing a table which correlates a plurality of positions of the movable point with the filter coefficients of the digital filter in said signal processing means, said table being generated by said noise detecting means said signal processing means, said coefficient renewing means and said residual-noise detecting means; and coefficient exchanging means, coupled to said coefficient register means and said position detecting means, for selecting one of the filter coefficients stored in the coefficient register means which is correlated with one of the positions of the movable point, which is closest to the position of the movable point detected by said position detecting means, and for substituting said one of the filter coefficients for the filter coefficient which is currently used in the digital filter in said signal processing means.

11. A noise controller according to claim 1, wherein said noise detecting means comprises:

a microphone for detecting the noise;

a low pass filter, coupled to the microphone, for filtering the noise detected by the microphone; and an analog-to-digital converter, coupled to the low pass filter, for generating the first signal by digitalizing an output of the low pass filter.

12. A noise controller according to claim 1, wherein the second signal is a digital signal, and wherein said antinoise generating means comprises:

a digital-to-analog converter, coupled to said signal processing means, for converting the second signal into an analog signal;

a low pass filter, coupled to the digital-to-analog converter, for generating the antinoise by filtering an output of the digital-to-analog converter; and an antinoise speaker, coupled to the low pass filter, for outputting the antinoise to the movable point.

13. A noise controller according to claim 1, wherein said antinoise generating means includes a plurality of antinoise speakers each of which outputs the antinoise to the movable point, and wherein said residual-noise detecting means includes a plurality of microphones, each of which is located at one of a plurality of noise-controllable points, the movable point moving within a noise-controllable zone defined by the noise-controllable points, and the antinoise speakers in said antinoise generating means outputting the antinoises to the noise-controllable points, so as to noise-control the noise-controllable zone as a whole.

14. A noise controller according to claim 13, wherein said position detecting means specifies in which noise-controllable zone the movable point is located, and wherein said noise controller further comprises:

point selecting means, coupled to said position detecting means and said antinoise generating means, for selecting at least one noise-controllable point responsible for the noise-controllable zone specified by said position detecting means; and speaker selecting means, coupled to said position detecting means and said residual-noise detecting means, for selecting at least one antinoise speaker responsible for the noise-controllable zone detected by the position detecting means, said antinoise generating means outputting the antinoise via the antinoise speaker selected by said speaker selecting means, to the noise-controllable point selected by the point selecting means.

15. A noise controller according to claim 13, wherein said noise-controllable points are classified into fixed points and virtual points, and wherein if the movable point is located at one of the fixed points, said coefficient renewing means renews the filter coefficient of the digital filter in said signal processing means by detecting the noise transmitted from the noise source to said movable point and a transfer function between the antinoise generating means and the movable point; and wherein said noise controller further comprises filter coefficient presuming means for presuming the filter coefficient of the digital filter in said signal processing means, if the movable point is located at one of the virtual points, by presuming the noise transmitted from the noise source to said movable point and the transfer function between the antinoise generating means and the movable point based on those detected by said coefficient renewing means.

* * * * *